US005540071A

United States Patent [19]

Reikher

[11] Patent Number: 5,540,071

[45] Date of Patent: Jul. 30, 1996

[54] LOCK CYLINDER WITH A BODY HAVING INTEGRAL SPRING RETAINER

[75] Inventor: Alexandre Y. Reikher, Shorewood, Wis.

[73] Assignee: Huf-North America Automotive Parts Manufacturing Corp., Germantown, Wis.

[21] Appl. No.: 389,516

[22] Filed: Feb. 16, 1995

[51] Int. Cl.[6] ..... E05B 29/04

[52] U.S. Cl. ..... 70/495; 70/492

[58] Field of Search ..... 70/491–496, 375, 70/DIG. 15

[56] References Cited

U.S. PATENT DOCUMENTS

| | | | |
|---|---|---|---|
| 2,003,086 | 5/1935 | Liss | 70/495 |
| 2,021,185 | 11/1935 | Hurd | 70/495 |
| 2,405,911 | 8/1946 | Swanson | 70/495 |
| 2,879,658 | 3/1959 | Johnstone | 70/495 |
| 2,949,762 | 8/1960 | Johnstone | 70/495 |
| 3,002,268 | 10/1961 | Spain | 70/495 |
| 3,709,006 | 1/1973 | Seidewand | 70/495 |
| 3,877,267 | 4/1975 | Harris, Jr. | 70/495 X |
| 4,446,709 | 5/1984 | Steinbach | 70/496 |
| 4,561,270 | 12/1985 | Spreng | 70/495 |
| 4,750,342 | 6/1988 | Nakai | 70/495 X |

FOREIGN PATENT DOCUMENTS

| | | | |
|---|---|---|---|
| 1425311 | 12/1965 | France | 70/495 |
| 2263265 | 6/1974 | Germany | 70/492 |
| 2758448 | 7/1979 | Germany | 70/492 |
| 144657 | 3/1954 | Sweden | 70/492 |
| 607199 | 8/1948 | United Kingdom | 70/495 |

*Primary Examiner*—Lloyd A. Gall
*Attorney, Agent, or Firm*—Quarles & Brady

[57] ABSTRACT

A lock cylinder includes a cylindrical body with first and second ends and a curved surface between those ends. A keyway extends from the first end into the cylindrical body for receiving a key that operates the lock. A slot extends from the curved surface to the keyway and has a separate pair of spaced apart lips spaced from opposite ends of the slot. A locking bar is within the slot and has a recess spaced from each end within which a pair of lips are received. Separate springs in each recess act against the pairs of lips to bias the locking bar into the cylindrical body. A plurality of tumblers are slideably located within the cylindrical body at a junction between the keyway and the slot. When the key is removed from the keyway, the tumblers push the locking bar to project from the curved surface of the cylindrical body. When the key is inserted fully into the keyway, the tumblers assume positions at which the locking bar is able to retract into the cylindrical body due to force exerted by the pair of springs against the lips.

15 Claims, 4 Drawing Sheets

FIG. 4
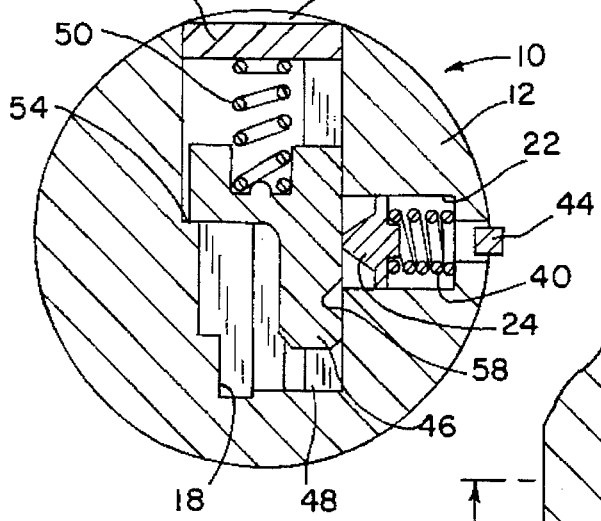
FIG. 5
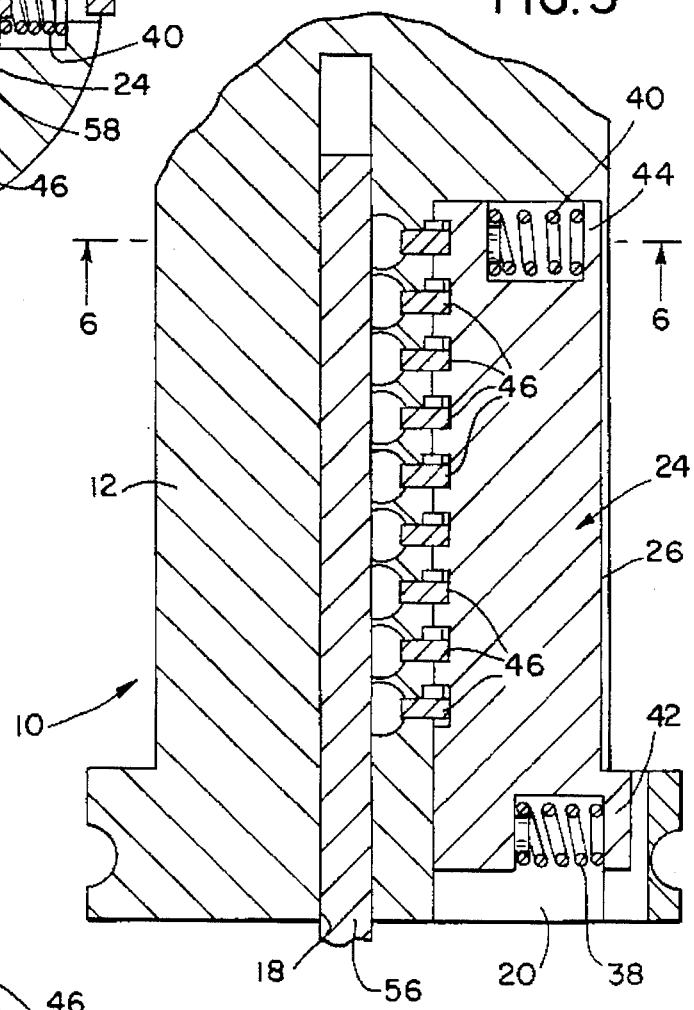
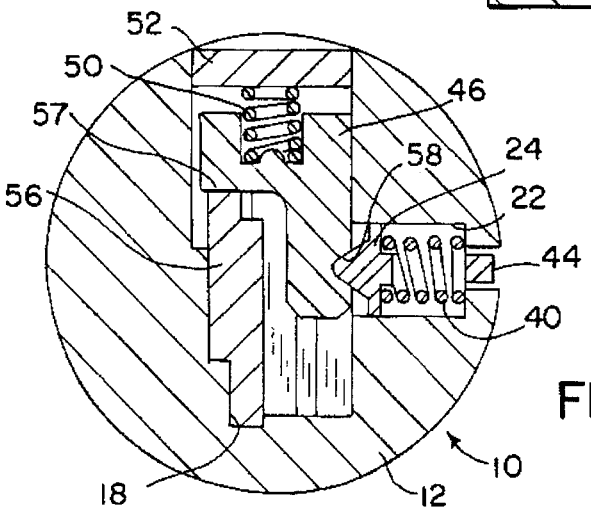
FIG. 6

LOCK CYLINDER WITH A BODY HAVING INTEGRAL SPRING RETAINER

BACKGROUND OF THE INVENTION

The present invention relates to lock cylinders, such as the type used with motor vehicle ignition switches; and more particularly to locking bars which inhibit rotation of the cylinder in the locked state.

Lock mechanisms commonly have a cylinder housed within a circular aperture in the body of the lock. The cylinder has a number of spring loaded tumblers which slide transversely to the direction of a longitudinal passageway into which the key is inserted. In a previous motor vehicle ignition lock, the tumblers engage a spring loaded bar which projects through a slot in the side of the cylinder. In the locked state, the tumblers force the bar to project outwardly from the cylinder and into a groove in the side of the aperture of the lock body. Thus, the bar engages both the cylinder and the lock body to prevent rotation of the cylinder.

When the proper key is inserted into the cylinder, a separate notch in the key cause the tumblers to slide transversely. The key notches are cut at various depths to slide the particular tumblers varying amounts. The proper key positions the tumblers so that the bar is released whereby spring force retracts the bar into the cylinder and out of engagement with the body of the lock mechanism. With the bar retracted, the user can turn the cylinder within the body.

Previously, the cylinder was assembled by inserting the bar into the slot in the side of the cylinder. Retaining members were placed across ends of the bar and into notches at the ends of the cylinder slot. Springs were located between the retaining members and the bar to bias the bar into the cylinder. Thus, the retaining members had to be held in place within the notches at the end of the slot while parts of the walls of the notches were peened to hold the retaining members in place. This assembly was relatively complex and required several operations. Therefore, it was desirable to simplify the design of the cylinder to facilitate assembly of the locking bar and its springs.

SUMMARY OF THE INVENTION

An object of the present invention is to provide a lock cylinder which is designed to facilitate assembly of the cylinder components.

Such a lock cylinder has a cylindrical body with first and second end surfaces and a curved surface between the end surfaces. A keyway extends from the first end surface into the cylindrical body and a slot extends between the curved surface and the keyway. A lip is located at the first end of the slot along the curved surface. A locking bar is movably received within the slot of the cylindrical body and has opposed first and second sides. The locking bar has a first end with a first recess and a second end with a second recess.

A first spring is located in the first recess and engages the locking bar and the lip to bias the locking bar into the cylindrical body. A second spring is located in the second recess and also biases the locking bar into the cylindrical body. A plurality of tumblers are within the cylindrical body at a junction between the keyway and the slot.

When the key is removed from the keyway, the tumblers maintain the locking bar in a state in which the first side of the locking bar projects from the curved surface of the cylindrical body. In an assembled lock, the projecting locking bar enters a notch in the lock body into which the cylinder fits and prevents the cylinder from turning in the lock body. When the proper key is inserted into the keyway, the tumblers slide into positions which allow the locking bar to retract into the cylindrical body due to bias force exerted by the pair of springs. In the retracted position, a user is able to turn the lock cylinder within the lock body.

BRIEF DESCRIPTION OF THE DRAWINGS

FIG. 4 is a transverse cross section taken along line 4—4 of the FIG. 3;

FIG. 5 is a longitudinal cross section similar to FIG. 3, but showing the cylinder in the unlocked state;

FIG. 6 is a transverse cross section taken along line 6—6 of FIG. 5;

DETAILED DESCRIPTION OF THE INVENTION

Figure 1:
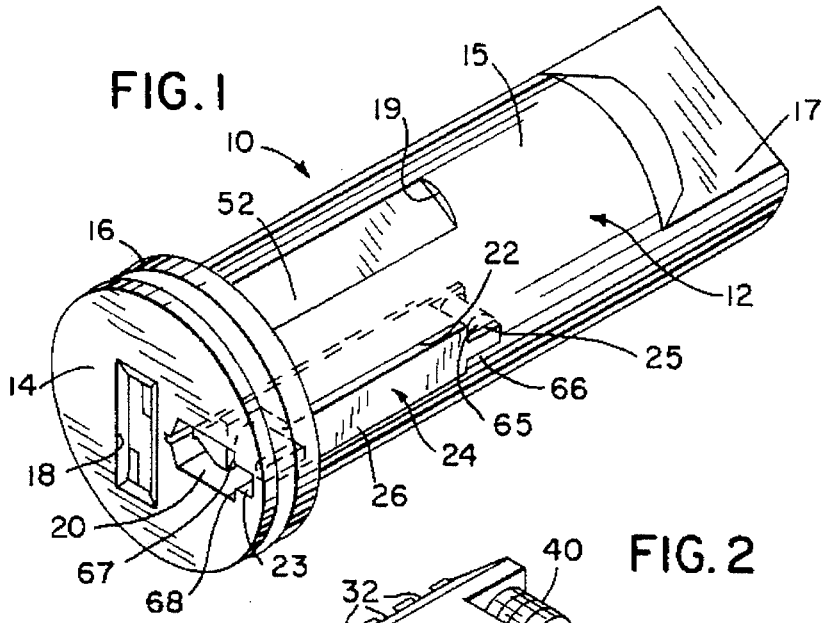
FIG. 1 is a pictorial view of a lock cylinder according to the present invention.

With initial reference to FIG. 1, a lock cylinder generally designated 10 comprises a cylindrical body 12 having a first end 14 with a flange 16 projecting outward there around. First end 14 has a keyway 18 extending longitudinally into the cylinder body 12. The keyway is of a conventional design having a cross section profile that mates with the cross section of the key that is intended to be inserted into the cylinder. The keyway has a longitudinal opening 19 along the curved surface 15 of the cylinder body 12. The first end 14 of body 12 also has an aperture 20 extending longitudinally into the cylinder body. Aperture 20 opens into a slot 22 in the curved surface 15. A locking bar 24 is positioned within slot 22 and protrudes outwardly through the slot 22 in the locked state of the cylinder 10. The second end 17 of the body has a flattened section for engaging the switch mechanism of the motor vehicle ignition.

The body 12 of the cylinder fits into a circular aperture in the lock housing (not shown) until the flange 16 abuts the surface of the housing. In the locked state, the locking bar 24 protrudes from the cylinder 10 into a notch in the wall of the aperture in the housing. The engagement of the locking bar 24 with both the cylinder slot 22 and the notch in the lock housing prevents the cylinder from rotating within the housing. As will be described, in the unlocked state, the locking bar 24 retracts into the body 12 of the cylinder 10 and is slightly recessed from the curved surface 15. In the retracted state, the locking bar no longer engages the notch in the lock housing enabling the user to rotate the cylinder.

Figure 2:
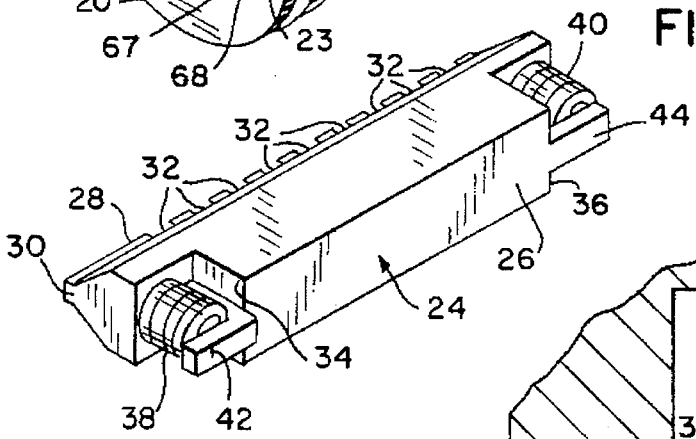
FIG. 2 is a subassembly of the lock cylinder in FIG. 1 showing the locking bar and associated springs.

With reference to FIG. 2, the locking bar 24 has an exterior side 26 which projects through the slot 22 in the assembled cylinder. Each end of the locking bar 24 along exterior side 26 has a recess 34 and 36. A separate helical bar spring 38 and 40 is held within each of the end recesses 34 and 36, respectively, by a spring retaining tab 42 and 44. Each tab 42 and 44 is narrower than the exterior side 26 and fits into narrow sections 23 and 25 at the ends of slot 22. The opposite or inner side 28 of the locking bar 24 tapers to a relatively thin central strip 30 which has nine grooves 32 cut therein and spaced along the length of the locking bar.

Figure 3:
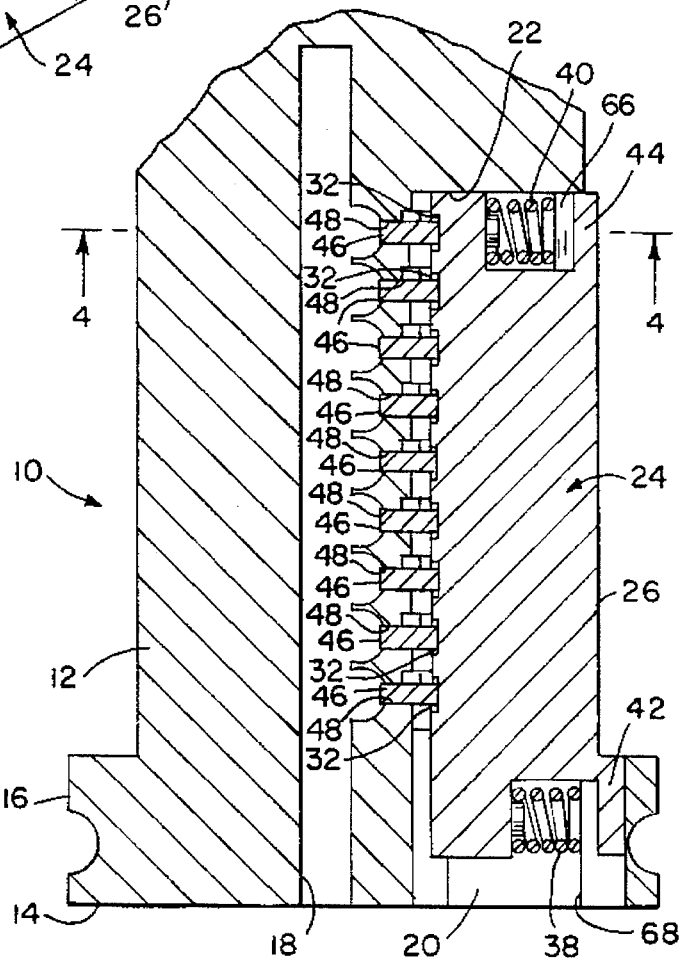
FIG. 3 is a horizontal longitudinal cross section through the lock cylinder of FIG. 1 in the locked state.

As shown in FIGS. 3 and 4, the grooves 32 of locking bar 34 receive nine tumblers 46. The tumblers 46 are slidably located within separate grooves 48 that are transverse to the longitudinal dimension of the keyway 18 and which extend between the keyway and the bottom of slot 22. Each of the tumblers 46 is biased by an individual helical spring 50 against a cap plate 52 as shown in FIG. 4. The cap plate 52 closes the longitudinal opening 19 of the keyway 18.

In the locked state shown in FIGS. 3 and 4, the tumbler springs 50 bias the tumblers 46 against a ridge 54 in the keyway 18. With the key removed from the cylinder 10, the tumblers force the locking bar 24 outward from the cylinder body 12 against the force of bar springs 38 and 40. In that position, one end of each of the bar springs 38 and 40 engages the recesses 34 and 36, respectively in the locking bar 24 while the other end of the bar springs abut the inside surface of the cylinder body 12 on the sides of slot sections 23 and 25 in FIG. 1. It is noted that when the locking bar 24 is inserted into the cylinder body 12, springs 38 and 40 no longer abut the spring retaining tabs 42 and 44, respectively. The spring retaining tabs 42 and 44 function primarily to hold the springs in place while the locking bar 24 is being inserted into the cylinder body. In the assembled state, springs 38 and 40 apply force which biases the locking bar 24 inward with respect to the exterior surface of the cylinder body. However, the position of tumblers 46 prevents the locking bar from retracting into the cylinder body. Thus, the first side 26 of the locking bar 24 protrudes from the exterior surface of the cylinder which as previously described causes the locking bar to engage a notch in the lock housing preventing the cylinder from rotating within the housing.

When a proper key 56 is inserted fully into the cylinder 10, as shown in FIGS. 5 and 6, the surface of the key engages the tumblers 46 causing them to move toward cap plate 52 against the force of tumbler springs 50. The notches 57 on the key surface cause the tumblers to slide into positions at which a depression 58 in each tumbler is aligned with the locking bar 24 enabling the small inner side surface of the locking bar to enter the depression. Each of the tumblers 46 assumes this position when the proper key is inserted into the keyway. The force of the locking bar springs 38 and 40 biases the locking bar inward so that the inner side surface 28 enters the depressions 58. This action causes the locking bar to retract into the cylinder body 12 so that the exterior side 26 of the locking bar is flush with or slightly recessed from the outer curved surface 15 of the cylinder body. Without the locking bar 24 protruding from the body 12, the cylinder 10 is able to rotate within the housing of the lock.

The lock cylinder 10 is assembled by initially placing the springs 38 and 40 into the recesses 34 and 36 in the locking bar 24 as shown in FIG. 2. Specifically with reference to FIG. 7, spring 38 is inserted into recess 34 between a retainer hub 60 and spring retaining tab 42. In a similar fashion, spring 40 is inserted into recess 36 at the other end of the locking bar 24 in between a different retainer hub 62 and the other spring retaining tab 44. The two spring retaining tabs 42 and 44 hold the bar springs 38 and 40 on the locking bar prior to assembly with the cylinder body 12.

Figure 7:
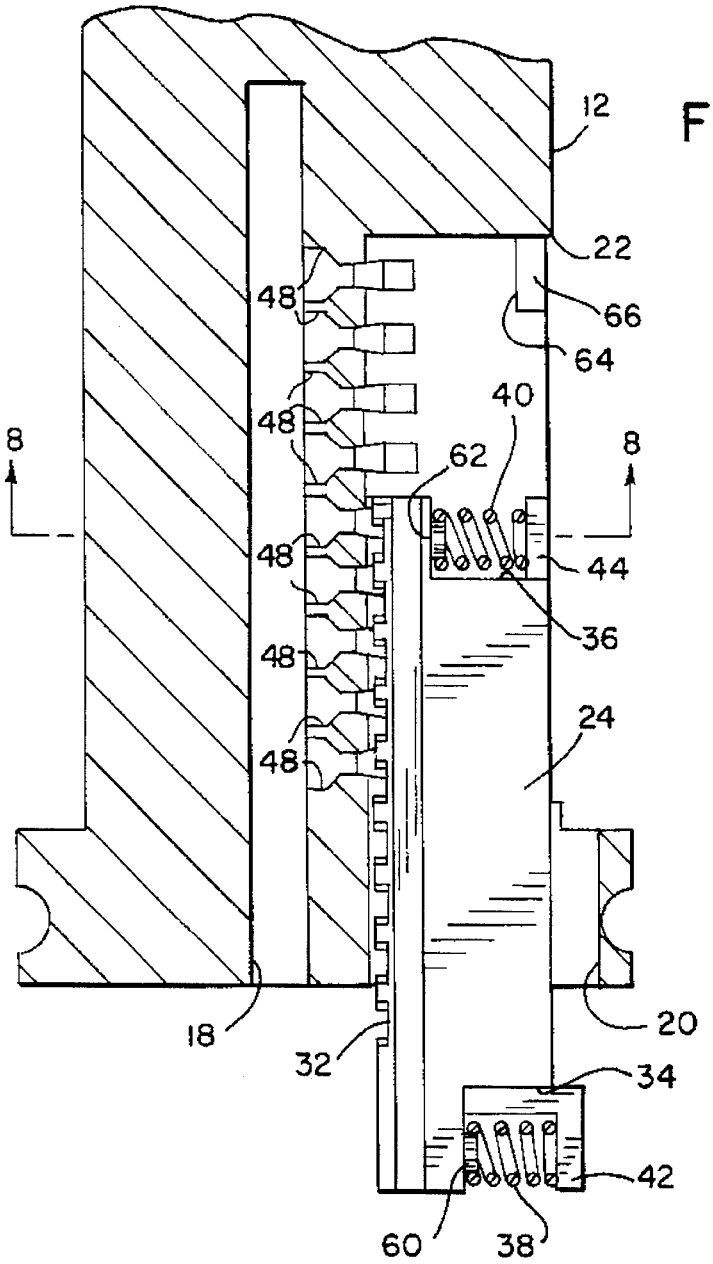
FIG. 7 is a horizontal longitudinal cross section through FIG. 1 showing the cylinder in an intermediate state of assembly.
Figure 8:
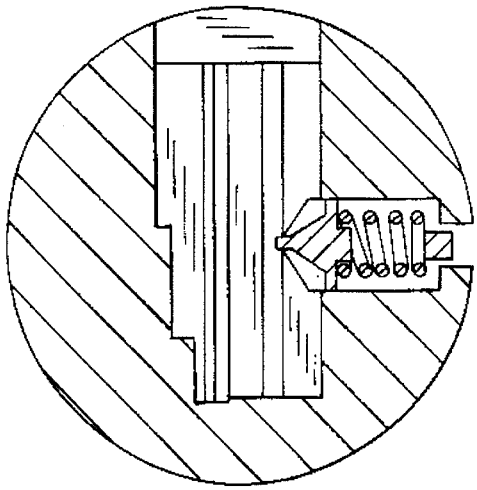
FIG. 8 is a transverse cross section taken along line 8—8 of FIG. 7.

The spring and locking bar assemblage then is slid into aperture 20 in the first end 14 of the cylinder body 12. FIG. 7 illustrates the assemblage in an intermediate state of insertion through the aperture 20. As the assemblage nears full insertion into the aperture 20, the locking bar 24 is manipulated by pressing it inward so that bar spring 40 slides under interior spring retaining surfaces 64 of a pair of lips 65 and 66 that extend into the locking bar slot 22 integral with cylinder body 12. This action also enables tab 44 to slide into the narrow section 25 of slot 22 that is formed between lips 65 and 66 as shown in FIG. 1. Similarly, bar spring 38 slides under spring retaining surfaces on another pair of lips 67 and 68 integral with the cylinder body 12 in aperture 20, as shown in FIGS. 1 and 3. Thus, once the locking bar has been slid all the way into aperture 20, the springs engage retaining surfaces of slot lips 25, 26, 67 and 68 instead of abutting the tabs 42 and 44 on the locking bar 24. Thus, the present design of the cylinder 10 enables the locking plate 24 to be inserted into the cylinder without requiring separate retaining members that are inserted over the springs and then peened in place as with prior designs.

After the locking bar 24 has been properly positioned, the tumblers 46 are inserted through the longitudinal opening 19 in the cylinder body and into the tumbler slots 48. A tumbler spring 50 then is placed on top of each tumbler 46 and the tumbler cap plate 52 is inserted into the longitudinal opening 19 in the cylinder body 12 as shown in FIG. 4. Next edges of the longitudinal opening 19 are peened over the cap plate 52 to hold the plate in place.

Figure 9:
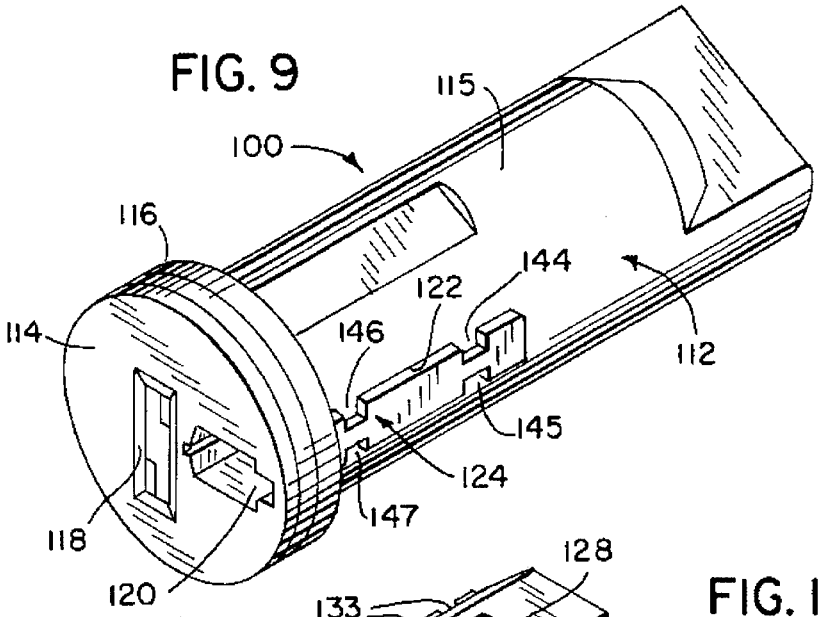
FIG. 9 is a pictorial view of another embodiment of a lock cylinder according to the present invention.

Referring to FIG. 9, a second embodiment of a lock cylinder 100 according to the present concept comprises a cylindrical body 112 having a first end 114 with a flange 116 projecting outward therearound. The first end 114 has a keyway 118 and an aperture 120 which extend longitudinally into the cylinder body. Aperture 120 opens into a slot 122 in the curved surface 115. A locking bar 124 is positioned within slot 122 and has an exterior side 126 which protrudes outwardly in the locked state of the cylinder 100.

Figure 10:
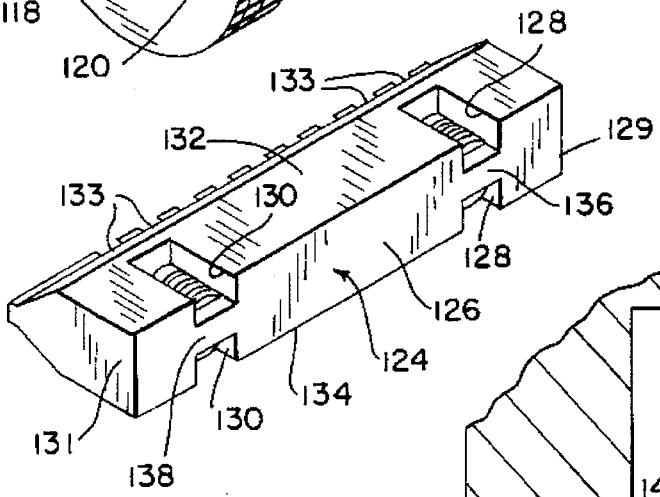
FIG. 10 is a subassembly of the lock cylinder in FIG. 9 showing the locking bar and associated springs.

As shown in detail in FIG. 10, the locking bar 124 has a first recess 128 spaced from one end 129 and has a second recess 130 spaced from the other end 131. Each recess 128 and 130 communicates between opposing lateral sides 132 and 134 of the locking bar which are perpendicular to the exterior side 126. A bridge tab 136 or 138 extends across each recess 128 and 130 along a central region of the exterior side 126. Separate helical bar springs 140 and 142 are within each of the first and second recesses 128 and 130, captivated by the respective bridge tab 136 or 138 (see also FIG. 11).

Figure 11:
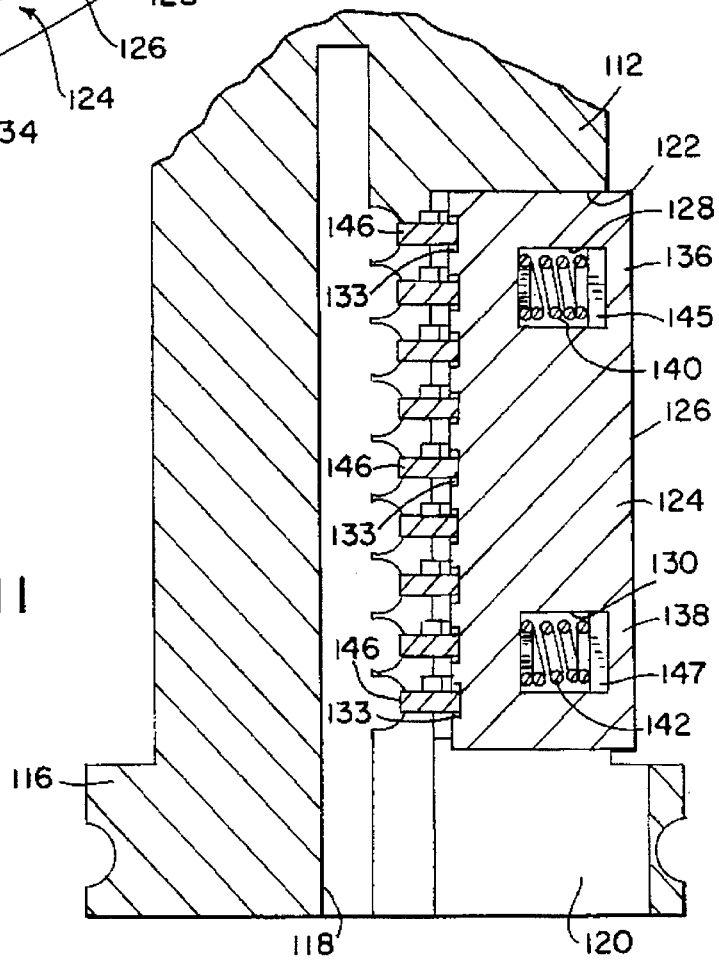
FIG. 11 is a horizontal longitudinal cross section through the lock cylinder of FIG. 9 in the locked state.

The cylindrical body 112 in FIG. 9 has four tab-like lips 144, 145, 146 and 147 on the curved surface 115 with each lip extending into slot 122 and into a recess 128 or 130 in the locking bar 124. The bar springs 140 and 142 abut the underside of lips 144–147 instead of the bridge tabs 136 and 138, when the locking bar is assembled into the slot 122 of the cylinder body 112, as illustrated in FIG. 11. Each pair of opposing lips 144–145 and 146–147 act as a spring retainer in the assembled lock cylinder 100. The primary function of the bridge tabs 136 and 138 is to hold the bar springs 140 and 142 in place while the locking bar 124 is being inserted into the cylinder body 112, similar to the spring retaining tabs 42 and 44 in the first lock cylinder 10.

Referring still to FIG. 11, the locking bar 124 has nine grooves 133 on the side opposite to exterior side 126 which groove receive nine tumblers 146. The tumblers 146 and the lock cylinder operation are the same are described previously with respect to the embodiment 10 in FIGS. 1–8.

I claim:

1. A lock cylinder comprising:

a cylindrical body with a first end surface, a second end surface, and a curved surface between the first and second end surfaces, a keyway extends from the first end surface into the cylindrical body for receiving a key, the cylindrical body further having a slot extending between the curved surface and the keyway with the slot formed by two opposed side surfaces extending substantially parallel to an axis of the cylindrical body, and the cylindrical body including a first pair of opposed lips each of which projects into the slot from a different one of the two side surfaces;

a locking bar received within the slot and having opposed first and second sides, said locking bar has a first recess;

a first spring located in the first recess and engaging said locking bar and the first pair of opposed lips to bias said locking bar into the cylindrical body; and a plurality of tumblers slideably located within the cylindrical body engaging said locking bar to cause the first side to project from the curved surface of the cylindrical body when the key is removed from the keyway, and to enable said first side to retract toward said cylindrical body when the key inserted into the keyway acts upon said plurality of tumblers.

2. The lock cylinder as recited in claim 1 wherein said cylindrical body further comprises an aperture in the first end surface and communicating with the slot to provide a passageway for inserting said locking bar into the slot.

3. The lock cylinder as recited in claim 1 wherein said cylindrical body has a second pair of opposed lips each of which projects into the slot from a different one of the two opposed side surfaces; and wherein said locking bar has a second recess; and further comprising a second spring located in the second recess engaging the second pair of opposed lips to bias said locking bar into the cylindrical body.

4. The lock cylinder as recited in claim 3 wherein:

said locking bar has one end at which the first recess is located and another end at which the second recess is located; and the slot in said cylindrical body has first and second ends with the first pair of opposed lips adjacent the first end of the slot and the second pair of opposed lips adjacent the second end of the slot.

5. The lock cylinder as recited in claim 4 wherein the one end of said locking bar has a first tab for holding the first spring in the first recess prior to insertion of the locking bar into said cylindrical body, and the other end of said locking bar has a second tab for holding the second spring in the second recess prior to insertion of the locking bar into said cylindrical body.

6. The lock cylinder as recited in claim 5 wherein said first pair of opposed lips are spaced apart to form a gap therebetween within which the first tab is movably received; and said second pair of opposed lips are spaced apart to form another gap therebetween within which the second tab is movably received.

7. The lock cylinder as recited in claim 3 wherein:

said locking bar has two ends with both the first recess and the second recess being spaced from the two ends; and the slot in said cylindrical body has first and second ends along the curved surface with both the first pair of opposed lips and the second pair of opposed lips being spaced from the first and second ends of the slot.

8. The lock cylinder as recited in claim 7 wherein said locking bar has a first bridge member extending across the first recess for holding the first spring in the first recess prior to insertion of the locking bar into said cylindrical body, and a second bridge member extending across the second recess for holding the second spring in the second recess prior to insertion of the locking bar into said cylindrical body.

9. The lock cylinder as recited in claim 8 wherein said first pair of opposed lips are spaced apart to form a narrow portion of the slot therebetween within which the first bridge member is movably received; and the second pair of opposed lips are spaced apart to form another narrow portion of the slot therebetween within which the second bridge member is movably received.

10. The lock cylinder as recited in claim 3 wherein said first spring and said second spring are helical springs.

11.The lock cylinder as recited in claim 1 wherein said first spring is a helical spring.

12. A lock cylinder comprising:

a cylindrical body with a first end surface, a second end surface, and a curved surface between the first and second end surfaces, a keyway extends from the first end surface into the cylindrical body for receiving a key, a slot with first and second ends along the curved surface and with a bottom which opens into the keyway, said cylindrical body also having a first pair of opposed lips extending into the slot and spaced from the first and second ends, and a-second pair of opposed lips extending into the slot and spaced from the first and second ends;

a locking bar is received within the slot of said cylindrical body and has opposed first and second sides, said locking bar has two ends with a first recess and a second recess each spaced from the two ends;

a first spring in the first recess of said locking bar and engaging the first pair of opposed lips to bias said locking bar into said cylindrical body;

a second spring in the second recess of said locking bar and engaging the second pair of opposed lips to bias said locking bar into said cylindrical body; and a plurality of tumblers slideably located within the cylindrical body engaging said locking bar to cause the first side to project from the curved surface of the cylindrical body when the key is removed from the keyway, and to enable said first side to retract toward said cylindrical body when the key inserted into the keyway acts upon said plurality of tumblers.

13. The lock cylinder as recited in claim 12 wherein said cylindrical body further comprises an aperture in the first end surface and communicating with the slot to provide a passageway for inserting said locking bar into the slot.

14. The lock cylinder as recited in claim 12 wherein said locking bar has a first bridge member extending across the first recess and a second bridge member extending across the second recess, the first bridge member and the second bridge member holding said first spring and said second spring in the first recess and second recess, respectively, prior to insertion of the locking bar into said cylindrical body.

15. The lock cylinder as recited in claim 14 wherein the first bridge member of said locking bar is received between the first pair of lips, and the second bridge member of said locking bar is received between the second pair of lips.

* * * * *